US005298959A

United States Patent [19]

Saito et al.

[11] Patent Number: 5,298,959

[45] Date of Patent: Mar. 29, 1994

[54] IMAGE FORMING APPARATUS WITH RE-FEEDING MEANS

[75] Inventors: Hironobu Saito, Yokohama; Mitsuhiro Mukasa, Kawasaki; Ryusei Kominato, Tokyo, all of Japan

[73] Assignee: Canon Kabushiki Kaisha, Tokyo, Japan

[21] Appl. No.: 970,824

[22] Filed: Nov. 3, 1992

[30] Foreign Application Priority Data

Nov. 8, 1991 [JP] Japan ..... 3-293033
Nov. 8, 1991 [JP] Japan ..... 3-319651

[51] Int. Cl.[5] ..... G03G 15/00

[52] U.S. Cl. ..... 355/319; 118/60; 118/DIG. 1; 355/285; 355/290; 355/321

[58] Field of Search ..... 355/282, 285, 289, 290, 355/283, 284, 319, 321, 23, 24; 219/216; 118/60, DIG. 1

[56] References Cited

U.S. PATENT DOCUMENTS 4,018,555 4/1977 Thetto ..... 118/60 X
4,087,676 5/1978 Fukase ..... 219/216
4,231,653 11/1980 Nagahara et al. ..... 118/60 X
4,285,295 8/1981 Iwao et al. ..... 118/60
4,397,936 8/1983 Sakata et al. ..... 118/60 X
5,047,809 9/1991 Owada et al. ..... 118/60 X
5,180,899 1/1993 Inasaki ..... 355/285 X

FOREIGN PATENT DOCUMENTS 0033136 3/1980 Japan ..... 118/60
0062572 3/1990 Japan ..... 355/284

*Primary Examiner*—Matthew S. Smith
*Attorney, Agent, or Firm*—Fitzpatrick, Cella, Harper & Scinto

[57] ABSTRACT

The present invention provides an image forming apparatus having an image forming device for forming a non-fixed image on a recording sheet, a fixing rotary member for fixing the non-fixed image to the recording sheet, a containing portion for containing the recording sheet to which the image was fixed by the fixing rotary member, a re-feeding device for re-feeding the recording sheet contained in the containing portion to the image forming device, and a coating device for coating a parting liquid to the fixing rotary member.

9 Claims, 7 Drawing Sheets

IMAGE FORMING APPARATUS WITH RE-FEEDING MEANS

BACKGROUND OF THE INVENTION

1. Field of the Invention

The present invention relates to an image forming apparatus such as a copying machine, an electrophotographic printer and the like, and more particularly, it relates to an image forming apparatus having a two-sided copying function or multi-copying function.

2. Related Background Art

Recently, the multi-functioning of image forming apparatuses has progressed, and image forming apparatuses having a two-sided copying function or multi-copying function have been popularized. For example, when images are formed on a single sheet on both sides, images are formed on a predetermined number of sheets on their one sides, which sheets are, in turn, stored in an intermediate tray. Then, the sheets stored in the intermediate tray are separated one by one and the separated sheet is re-fed to an image forming station where an image is formed on the sheet on the other side.

However, in re-feeding the sheet, the image formed on the sheet rubs against the other sheet to smudge an end portion of the other sheet. Particularly, in a case of an arrangement wherein the sheets are successively re-fed from a lowermost sheet of the sheet stack stored on the intermediate tray, the speed-up of the operation is contemplated so that the re-feeding of the sheet can be effected before the predetermined number of sheets are received in the intermediate tray. However, in this case, since the lowermost sheet is fed first, the sheet stack on the sheet to be separated is always entered into a separating station Z where the lowermost sheet is separated from the next sheet on the lowermost sheet while being rubbed against the next sheet (FIG. 8). As a result, since the sheets are stacked or stored on the intermediate tray with the imaged surfaces facing up in the two-sided copying mode, toner particles 52 forming the image on the sheet to be fed by a re-feeding means are moved while being rubbed against the undersurface of the upper sheet 53 at a range 52*a* (shown by the hatched area), thus causing the contamination 54 at the end portion of the upper sheet.

Further, in a case where a mold-releasing agent or parting agent is coated to a fixing roller to prevent the offset phenomenon, since the parting agent is absorbed in the sheets, the coefficient of friction between the sheets is decreased. As a result, it will be difficult to cause the above-mentioned contamination of the sheet in the re-feeding operation. However, as shown in FIG. 9, since a length A of an area of the fixing roller 61 to which oil is coated to the fixing roller by means of an oil coating means 62 is greater than a width B of the largest sheet S which can be used in an image forming apparatus, the consumption of oil will be increased.

SUMMARY OF THE INVENTION

An object of the present invention is to provide an image forming apparatus which can prevent contamination of sheets in a re-feeding operation.

Another object of the present invention is to provide an image forming apparatus which can reduce the consumption of parting agent.

A further object of the present invention is to provide an image forming apparatus which can coat parting agent to an area that is smaller than a fixing area of a fixing rotary member and which correspond to a separating area of a separating rotary member of a re-feeding means.

The other objects of the present invention will be apparent from the following descriptions.

DETAILED DESCRIPTION OF THE PREFERRED EMBODIMENTS

Figure 1:
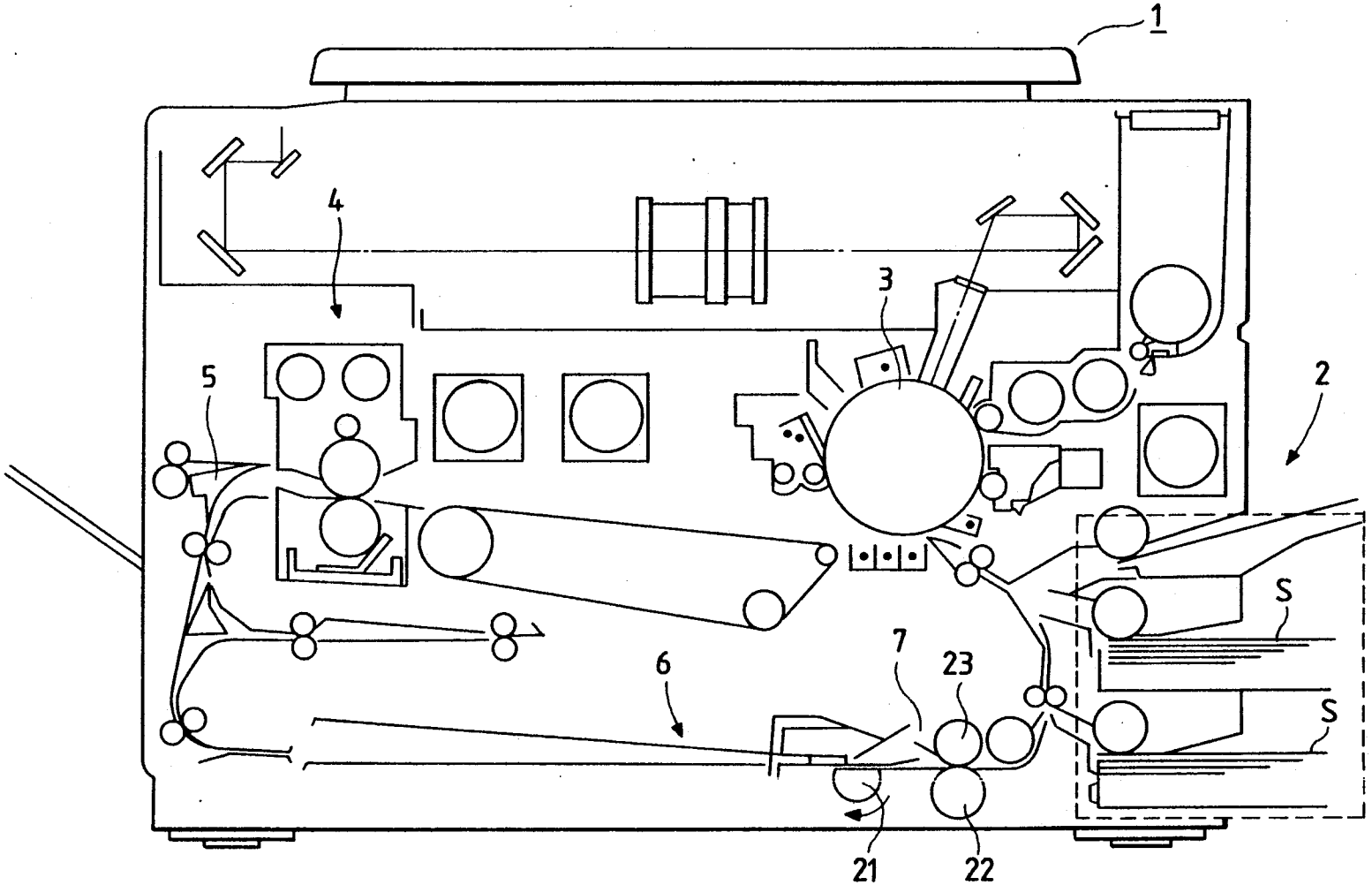
FIG. 1 is an elevational sectional view of an image forming apparatus according to a preferred embodiment of the present invention.

FIG. 1 is a sectional view of an image forming apparatus according to a preferred embodiment of the present invention. In the image forming apparatus according to this embodiment, both a two-sided copying mode wherein images are formed on a recording sheet on both sides and a multi-copying mode wherein an image is formed on a same recording sheet on a one side by several times can be performed.

In FIG. 1, in the case of the two-sided copying mode of the image forming apparatus 1, a powder toner image is formed at image forming station 3 on a sheet supplied from a sheet supply station 2 in a conventional electrophotographic technique. After the toner image is fixed to the sheet with heat and pressure by a fixing device 4, the sheet is sent, via a flapper 5, to an intermediate tray 6 on which the sheet is stored with an imaged surface thereof facing up. The sheets stored or stacked on the intermediate tray are separated and fed one by one from a lowermost sheet by a re-feeding means 7 so that the separated sheet is sent to the image forming station 3, where an image is formed on the sheet on the other side.

Figure 2:
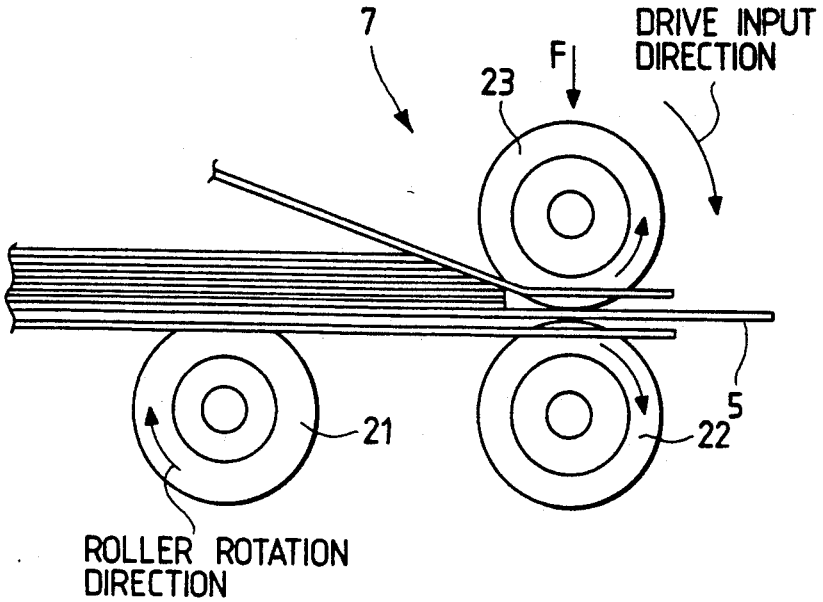
FIGS. 2 and 3 are sectional views of a re-feeding means of the apparatus of FIG. 1.
Figure 3:
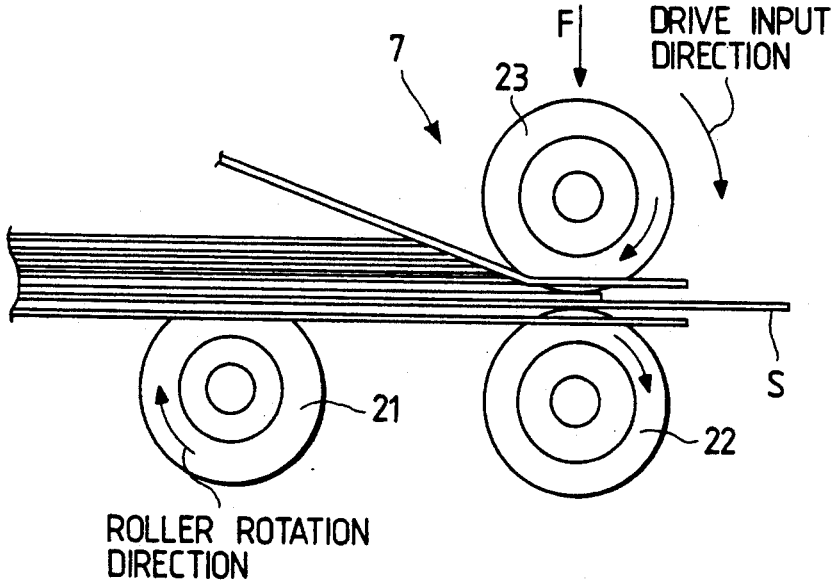
Figure 4:
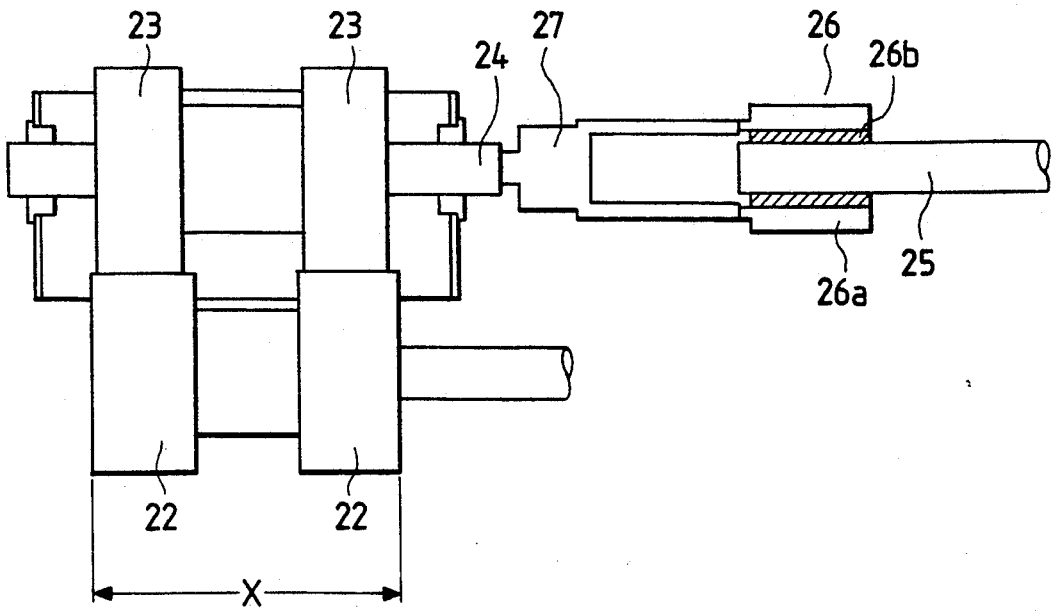
FIG. 4 is a side view of the re-feeding means of the apparatus of FIG. 1.

FIGS. 2 and 3 are sectional views of the re-feeding means 7 for re-feeding the sheet from the intermediate tray, and FIG. 4 is a side view of the re-feeding means.

In FIGS. 2 to 4, the re-feeding means is constituted by a convey roller 21, a sheet supply roller 22 and a separation roller 23. The convey roller 21 serves to separate and feed a lowermost sheet from among the sheets stacked on the intermediate tray 6 to the paired rollers 22, 23. The separation roller 23 is urged against the sheet supply roller 22 by a pressurizing means (not shown) to create a pinching force F therebetween, and a shaft 24 of the separation roller is driven to return the sheet back by means of a drive source via a torque limiter 26. The torque limiter 26 comprises a torque limiter shaft 25 and a barrel portion 26*a* connected to the torque limiter shaft by a magnetic member 26*b*, and is so designed that when a torque applied to the barrel portion 26*a* is lower than a predetermined value T the barrel portion 26*a* is rotated together with the torque limiter shaft 25 and when the torque exceeds the predetermined value T the barrel portion 26*a* is rotated independently from the torque limiter shaft 25. The separation roller shaft 24 is connected to the barrel portion 26*a* of the torque limiter 26 via a coupling 27. Now, when the coefficient of friction between surfaces of the sheet supply roller 22 and the separation roller 23 and the sheet is $\mu 1$, the coefficient of friction between the sheets is $\mu 2$, the radii of the sheet supply roller 22 and the separation roller 23 is R, and the weight of the sheet stack on the sheet to be fed is selected to have relations $\mu 1 > \mu 2$, $T/\mu 1/R + \mu 2/\mu 1 < F < T/\mu 2/R - 2$ regarding the values F and T, the following occurs: if a single sheet enters the separating station, the separation roller 23 will rotate in the sheet convey direction (FIG. 2), and if two or more sheets enter the separating station, the separation roller 23 will rotate in a drive input direction to return the second sheet, thus preventing the double-feed of the sheets (FIG. 3).

Figure 5:
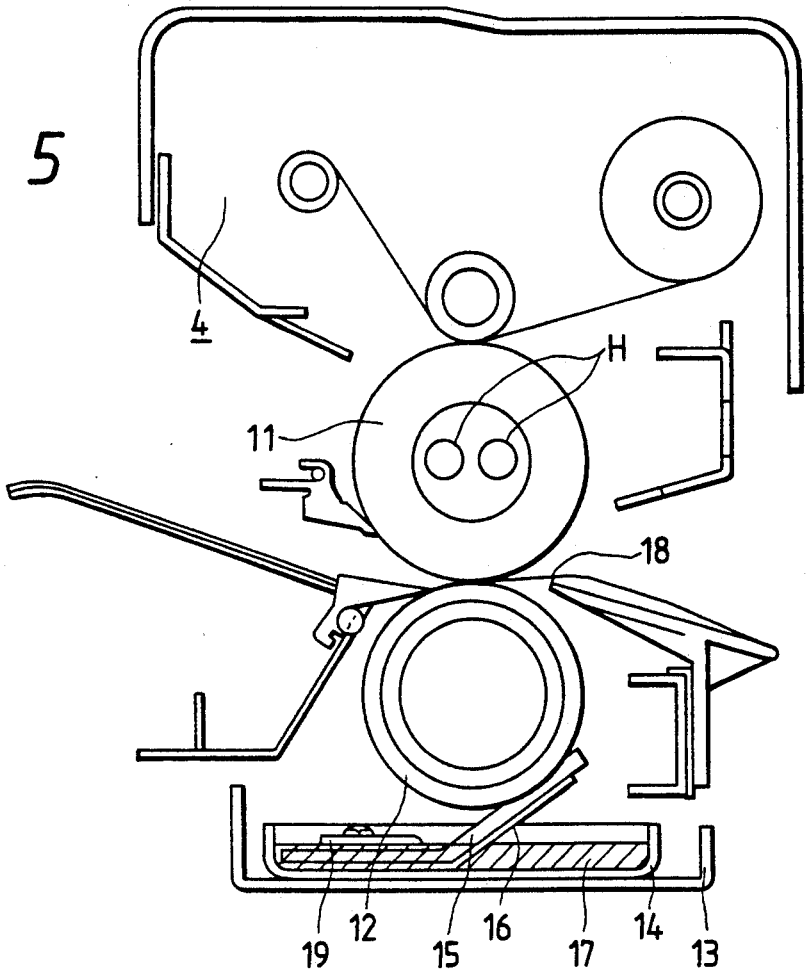
FIG. 5 is a sectional view of a fixing device of the apparatus of FIG. 1.
Figure 6:
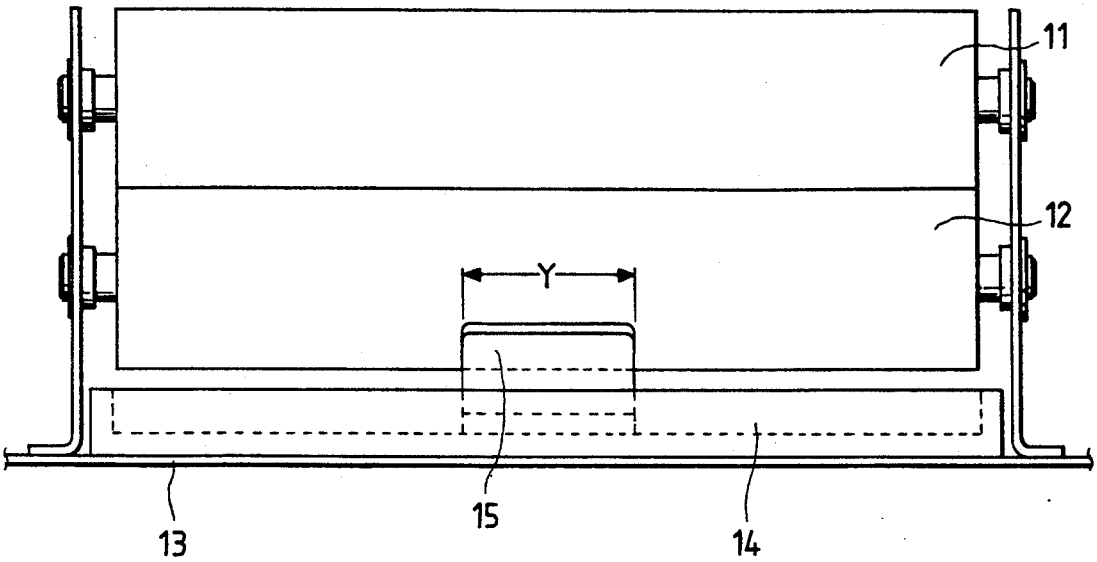
FIG. 6 is a side view of the fixing device of FIG. 5.

FIG. 5 is an enlarged sectional view of the fixing device 4, and FIG. 6 is a side view of the fixing device. In FIGS. 5 and 6, the fixing device 4 comprises an upper fixing roller 11 having heaters H therein, and a lower fixing roller 12, and a nip 18 is formed between the upper and lower fixing rollers. When the recording sheet with the non-fixed toner image thereon facing toward the upper fixing roller is sent to the fixing device, the toner image is fixed to the recording sheet with heat and pressure while the sheet is being passed through the nip 18.

An oil holding container 14 containing parting oil 17 consisting of silicone oil therein is attached to a bottom plate 13 of the fixing device. An oil coat felt 15 immersed into the oil is attached to the oil holding container 14 therewithin by a felt attaching plate 19 and is urged against the lower fixing roller 12 by means of a leaf spring 16.

Figure 7:
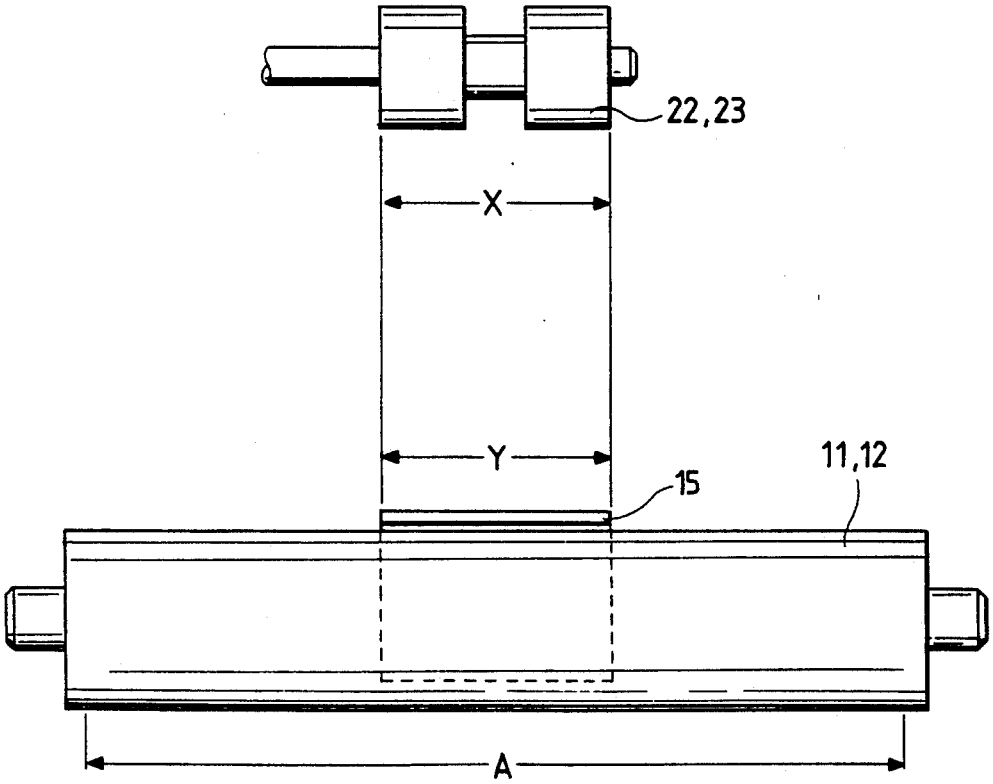
FIG. 7 is a view showing the relation between an area where parting agent is coated and a separating rotary member, according to the preferred embodiment.
Figure 8:
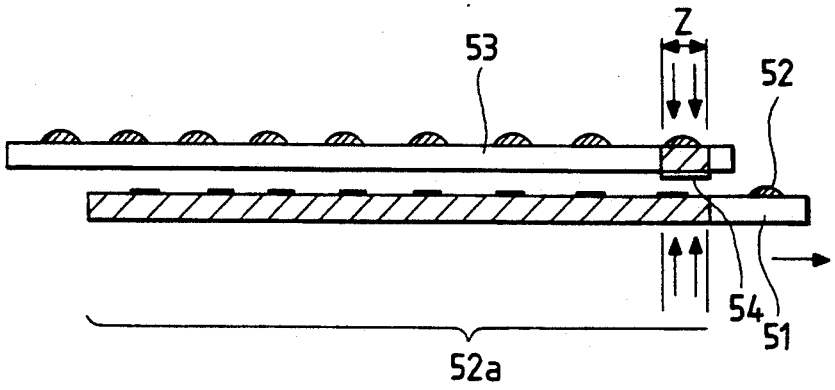
FIG. 8 is a view for explaining contamination of a recording sheet.
Figure 9:
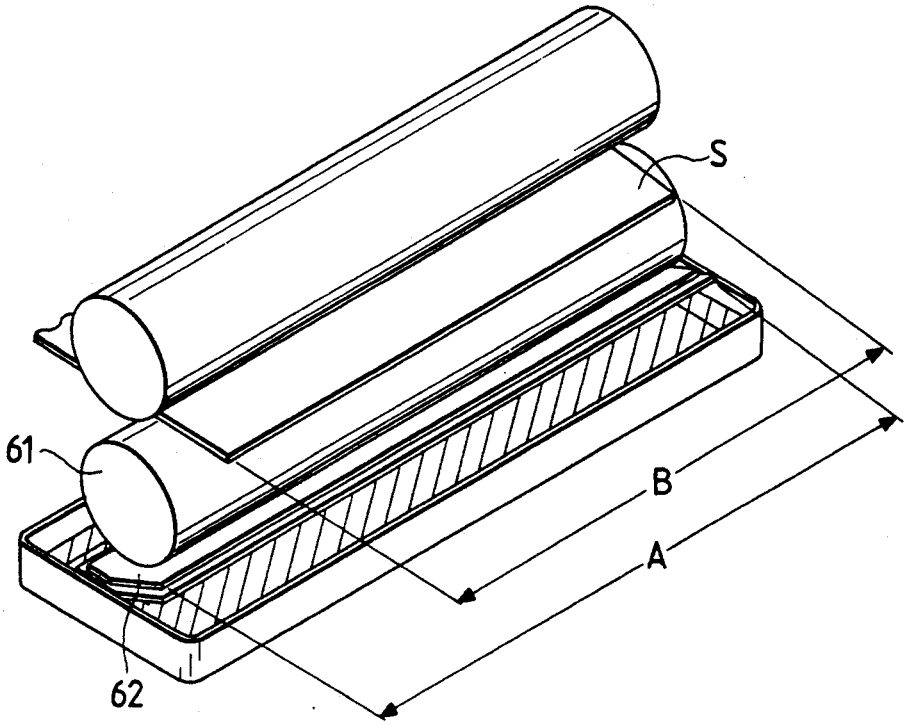
FIG. 9 is a perspective view showing an example of a fixing device having a parting agent coating means.

FIG. 7 shows a relation between a width of the oil coat felt 15 and widths of the separation roller and the sheet supply roller. As shown in FIG. 7, the oil coat width is selected so that it is smaller than a maximum sheet passing area A corresponding to a fixing area and is substantially equal to the widths X of the sheet supply roller 22 and the separation roller 23. Thus, the oil coated on the lower fixing roller 12 by the oil coat felt 15 is applied to the sheet being passed through the nip 18, thus reducing the coefficient of friction between the sheets within a range corresponding to the widths X of the sheet supply roller 22 and the separation roller 23.

Further, the parting agent (liquid) is applied hot and is coated on the sheet by the heated fixing rotary member. Thus, since the parting liquid has the low viscosity due to the heat, any parting liquid having high viscosity and low volatility can be used.

Incidentally, the image forming means of the present invention is not limited to the above-mentioned electrophotographic means, but may be of electrostatic recording type or any other appropriate type. As mentioned above, according to the preferred embodiment of the present invention, it is possible to prevent the contamination of a recording sheet in the re-feeding operation in the two-sided copying mode and the multi-copying mode with less consumption of the parting liquid.

Next, a more preferred embodiment of the present invention will be explained.

Figure 10:
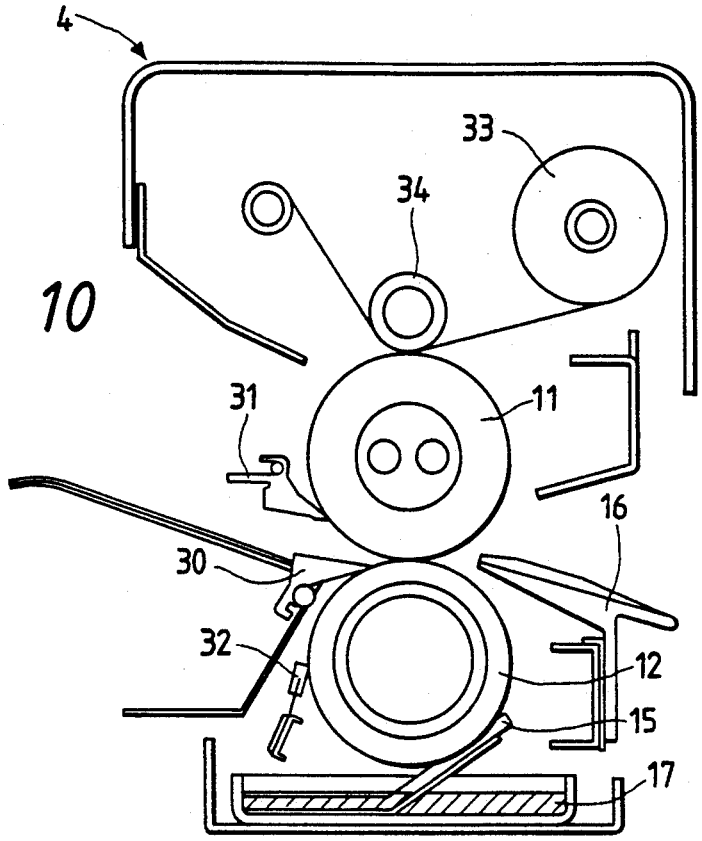
FIG. 10 is a sectional view of a fixing device according to another embodiment of the present invention.

FIG. 10 is a sectional view of a fixing device according to the more preferred embodiment. Incidentally, in this embodiment, the overall construction of an image forming apparatus is the same as that of FIG. 1. In FIG. 10, the reference numeral 30, 31 denote separating claws; 33 denotes a cleaning web impregnating therein silicone oil as a parting liquid; and 34 denotes an urging roller.

In this embodiment, in addition to the arrangement shown in FIG. 5, a blade 32 acting as a cleaning member is disposed at an upstream side of a contacting area (with the lower fixing roller 12) of the oil coat felt 15 in a rotation direction of the lower fixing roller (pressure roller) 12 and at a downstream side of the nip between the upper fixing roller 11 and the lower fixing roller 12 in the rotation direction. The blade 32 is made of elastic rubber and is abutted against the pressure roller 12.

Figure 11:
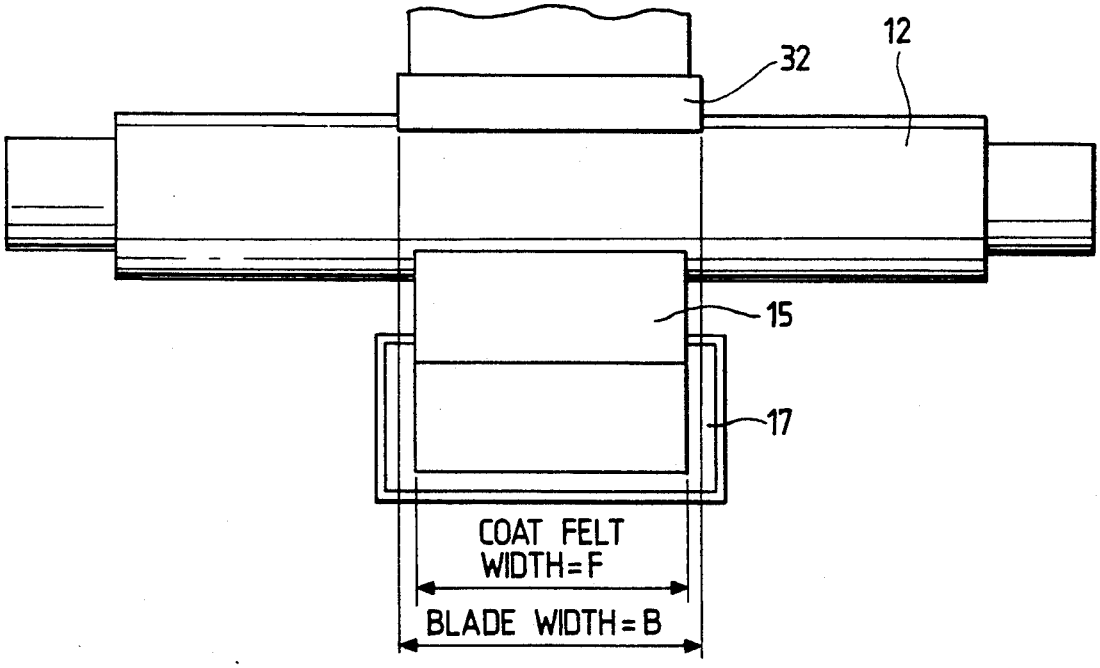
FIG. 11 is a view for explaining the relation between a contacting width of a parting agent coating member in the embodiment of FIG. 10 and a contacting area of a cleaning member.

As shown in FIG. 11, a width B of the blade 32 is narrower than a fixing area, but is greater than a coating area, i.,e, a width F of the oil coat felt 15. The coating area is included within a range of a contacting area between the blade and the pressure roller 12. If the paper powder is adhered to the pressure roller, it is feared that the parting oil is not effectively applied to the pressure roller.

To prevent this, in the illustrated embodiment, by arranging the blade 32 at the downstream side of the nip between fixing roller 11 and the pressure roller 12 in the rotation direction of the pressure roller 12 and at the upstream side of the contacting area between the coat felt 15 and the pressure roller 12 in the rotation direction, the paper powder adhered to the pressure roller 12 is removed. As a result, the surface of the pressure roller is always maintained in a clean condition, whereby the oil coated on the pressure roller 12 is effectively transferred onto the back surface of the sheet (opposite to the imaged surface). Accordingly, when the separating process in the re-feeding operation is effected by the sheet re-feeding station 7, the sliding resistance between the sheets is reduced, thereby preventing the developing agent (toner) from transferring to the other sheet.

Figure 12:
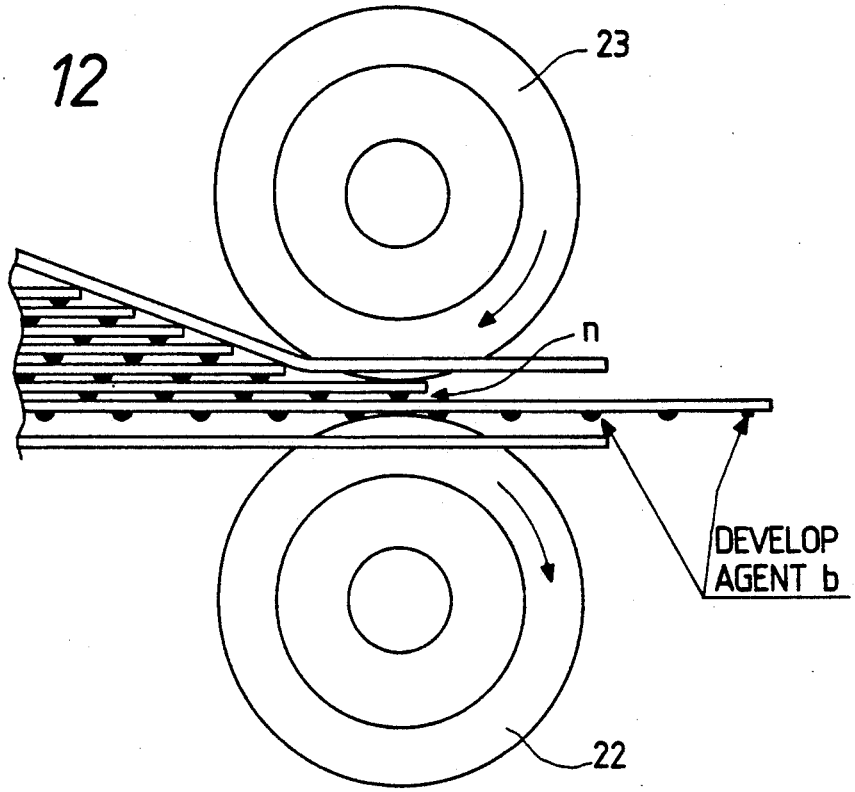
FIG. 12 is an enlarged sectional view of a re-feeding portion in a multi-copying operation.
Figure 13:
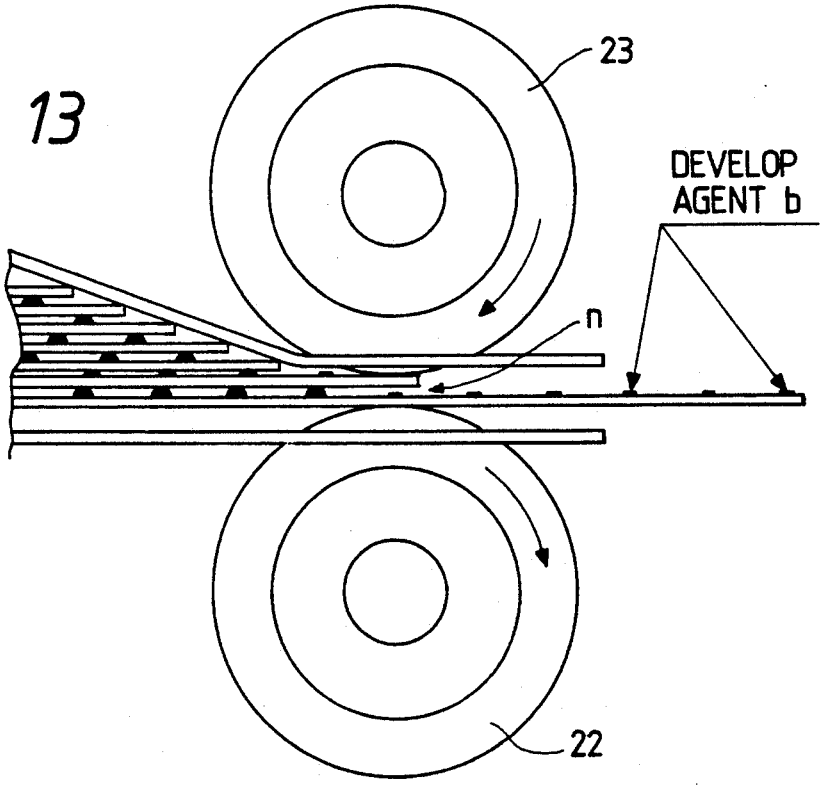
FIG. 13 is an enlarged sectional view of the re-feeding portion in a two-sided copying operation.

Incidentally, FIG. 12 is an enlarged partial sectional view of the sheet supply roller and the separation roller, showing the re-feeding of the sheet in the multi-copying mode, and FIG. 13 is an enlarged partial sectional view of the sheet supply roller and the separation roller, showing the re-feeding of the sheet in the two-sided copying mode.

While the present invention was explained with reference to the specific embodiments, it is not limited to such embodiments, but various alterations can be effected within the scope of the present invention.

What is claimed is:

1. An image forming apparatus, comprising:

image forming means for forming a non-fixed image on a recording sheet;

a fixing rotary member for fixing the non-fixed image to the recording sheet;

a containing portion for containing the recording sheet to which the image was fixed by said fixing rotary member;

re-feeding means for re-feeding the recording sheet contained in said containing portion to said image forming means, said re-feeding means including a separation rotary member for separating the recording sheets contained in said containing portion one by one; and coating means for coating a parting liquid to said fixing rotary member, said coating means for coating the parting liquid on an area of said fixing rotary member smaller than a fixing area of said fixing rotary member and substantially equal to an area corresponding to said separation rotary member.

2. An image forming apparatus according to claim 1, wherein said coating means coats the parting liquid on an area of said fixing rotary member having a width substantially equal to a width of said separation rotary member.

3. An image forming apparatus according to claim 1, wherein said fixing rotary member contacts with a surface of the recording sheet opposite to a surface on which the non-fixed image is born.

4. An image forming apparatus according to claim 1, wherein said fixing rotary member is in a heated condition during a fixing operation.

5. An image forming apparatus according to claim 4, further comprising a heating rotary member, and wherein the recording sheet on which the non-fixed image was formed is pinched between and fed by said heating rotary member and said fixing rotary member, thereby fixing the non-fixed image.

6. An image forming apparatus according to claim 1, wherein the recording sheets are stacked on said containing portion with image surfaces thereof facing upside, and said separation rotary member successively separates the stacked recording sheets from a lowermost recording sheet.

7. An image forming apparatus according to claim 1, further comprising an additional rotary member which cooperates with said fixing rotary member to form a nip therebetween, and a cleaning member disposed at a downstream side of said nip in a rotation direction of said fixing rotary member and at an upstream side of a parting liquid coating position in the rotation direction of said fixing rotary member.

8. An image forming apparatus according to claim 7, wherein said cleaning member is an elastic blade slidingly contacting with a surface of said fixing rotary member.

9. An image forming apparatus according to claim 7, wherein a cleaning area of said cleaning member is smaller than said fixing area and includes a parting liquid coating area.

* * * * *

UNITED STATES PATENT AND TRADEMARK OFFICE

CERTIFICATE OF CORRECTION

PATENT NO. : 5,298,959
DATED : March 29, 1994
INVENTOR(S) : HIRONOBU SAITO, ET AL.

It is certified that error appears in the above-indentified patent and that said Letters Patent is hereby corrected as shown below:

Title Page:
Item [56] References Cited, "Thetto" should read --Thettu--.

Column 4,
Line 12, "numeral" should read --numerals--.

Column 5,
Line 22, "born." should read --borne.--.

Signed and Sealed this

Thirtieth Day of August, 1994

*Attest:*

*Attesting Officer*

Bruce Lehman

BRUCE LEHMAN

*Commissioner of Patents and Trademarks*